US007919220B2

(12) United States Patent
Shimoyama et al.

(10) Patent No.: US 7,919,220 B2
(45) Date of Patent: Apr. 5, 2011

(54) ELECTROPHOTOGRAPHIC PHOTORECEPTOR, IMAGE FORMING APPARATUS AND PROCESS CARTRIDGE

(75) Inventors: Keisuke Shimoyama, Numazu (JP); Eiji Kurimoto, Numazu (JP); Shinichi Kawamura, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 334 days.

(21) Appl. No.: 11/929,083

(22) Filed: Oct. 30, 2007

(65) Prior Publication Data

US 2008/0113286 A1 May 15, 2008

(30) Foreign Application Priority Data

Nov. 14, 2006 (JP) ..... 2006-307475

(51) Int. Cl.
*G03G 5/06* (2006.01)

(52) U.S. Cl. ..... 430/78; 399/159

(58) Field of Classification Search ..... 430/78; 399/159

See application file for complete search history.

(56) References Cited

U.S. PATENT DOCUMENTS 4,971,877 A * 11/1990 Miyamoto et al. ..... 430/76
5,567,559 A * 10/1996 Yang et al. ..... 430/59.5
7,747,197 B2 * 6/2010 Shimoyama et al. ..... 430/58.5
2007/0059039 A1 3/2007 Shimoyama et al.

(Continued)

FOREIGN PATENT DOCUMENTS

JP 6-130688 5/1994

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-168.*

(Continued)

*Primary Examiner* — Christopher RoDee
(74) *Attorney, Agent, or Firm* — Oblon, Spivak, McClelland, Maier & Neustadt, L.L.P.

(57) ABSTRACT

An electrophotographic photoreceptor, comprising:
an electroconductive substrate; and
a photosensitive layer located overlying the electroconductive substrate,
wherein the photosensitive layer is a single-layered layer comprising a charge generation material and an electron transport material having the following specific formula (1):

(1)

wherein the charge generation materials is a titanylphthalocyanine having a specific CuKα 1.542 Å X-ray diffraction spectrum.

8 Claims, 8 Drawing Sheets

U.S. PATENT DOCUMENTS

| | | | |
|---|---|---|---|
| 2007/0059618 | A1 | 3/2007 | Kurimoto et al. |

FOREIGN PATENT DOCUMENTS

| | | |
|---|---|---|
| JP | 2584682 | 11/1996 |
| JP | 3003664 | 11/1999 |
| JP | 2001-19871 | 1/2001 |
| JP | 3183807 | 4/2001 |
| JP | 3239244 | 10/2001 |
| JP | 3273543 | 2/2002 |
| JP | 3471163 | 9/2003 |
| WO | WO 2005/092901 A1 | 10/2005 |

OTHER PUBLICATIONS

English language translation of JP 2001-19871 (Jan. 2001).*

* cited by examiner

ELECTROPHOTOGRAPHIC PHOTORECEPTOR, IMAGE FORMING APPARATUS AND PROCESS CARTRIDGE

BACKGROUND OF THE INVENTION

1. Field of the Invention

The present invention relates to an electrophotographic photoreceptor, and to an image forming apparatus and a process cartridge using the electrophotographic photoreceptor.

2. Discussion of the Background

Recently, development of information processing systems utilizing electrophotography is remarkable. In particular, optical printers in which information converted to digital signals is recorded using light have been dramatically improved in print qualities and reliability. This digital recording technique is applied not only to printers but also to copiers, and so-called digital copiers have been developed and used. Copiers utilizing both the conventional analogue recording technique and this digital recording technique have various information processing functions, and therefore it is expected that demand for such copiers will be escalating. In addition, with popularization and improvement of personal computers, the performance of digital color printers which can produce documents.

Electrophotographic photoreceptors for use in these image forming apparatuses are broadly classified into organic photoreceptors and inorganic photoreceptors. Recently, the organic photoreceptors are widely used because of having advantages of being produced more easily with less cost, able to use more various materials such as charge transport materials, charge generation materials and binder resins, and more freely designed than the inorganic photoreceptors.

The organic photoreceptors include a single-layered photoreceptor wherein a charge transport material (CTM) including a positive-hole transport material and an electron transport material, and a charge generation material (CGM) are dispersed together in a same photosensitive layer; and a multilayered photoreceptor wherein a charge generation layer (CGL) including a CGM and a charge transport layer (CTL) including a CTM.

Most of the multilayered photoreceptors are negatively charged, and positively-charged multilayered photoreceptors are not in practical use. This is because CTMs having good charge transportability, less toxicity and high compatibility with a binder resin are not in practical use.

However, the negatively-charged photoreceptor is not stably charged with a corona charger and produces ozone or NOx, which are absorbed to the surface of the photoreceptor, resulting in physical and chemical, and further environmental deterioration. Therefore, the positively-charged photoreceptor having more flexible use conditions is more advantageously used.

The positively-charged photoreceptors include single-layered photoreceptors. Most of the single-layered photoreceptors include both of the positive-hole transport material and the electron transport materials as a charge transport material, and therefore the single-layered photoreceptor has a sensitivity having both positive and negative polarity. However, most of the single-layered photoreceptors are positively charged because of having better sensitivity and taking advantage of the merits of being positively charged.

Japanese Published Unexamined Patent Applications Nos. 8-328275, 7-64301, 9-281729, 6-130688 and 9-151157 disclose single-layered organic photoreceptors, which have higher residual potential, and larger variation of potential due to repeated use and after irradiated than functionally-separated multilayered photoreceptors.

In order to solve such problems of the single-layered photoreceptors, new electron CTMs are now being developed. A tetracarboxylic acid and a naphthalenecarboxylic acid disclosed in WO2005092901 having good charge transportability can solve the problems and largely improve the electrostatic characteristics of the single-layered photoreceptors.

Further, the image forming apparatus is required to downsize and print at higher speed recently, and the photoreceptor is required to have high sensitivity. Latest digital image forming apparatuses typically use a laser diode (LD) and a light emitting diode (LED) mostly having a near-infrared area wavelength of from 680 to 830 nm. Therefore, electrophotographic photoreceptors using phthalocyanines, particularly a titanylphthalocyanine (TiOPc) having high sensitivity to the near-infrared area as a CGM are actively developed.

Various crystal forms of the titanylphthalocyanine are known, and particularly a titanylphthalocyanine crystal having a CuKα 1.542 Å X-ray diffraction spectrum comprising a maximum diffraction peak at a Bragg (2θ) angle of 27.2° disclosed in Japanese Published Unexamined Patent Applications Nos. 2001-19871, 11-5919 and 3-269064 is known to have very high carrier generability.

Multilayered electrophotographic photoreceptors using this titanylphthalocyanine crystal are in practical use, but single-layered ones are not good. This is because the titanylphthalocyanine crystal deteriorates the chargeability of photoreceptors, particularly single-layered ones.

A single-layered photoreceptor including a CTM for use in the present invention in a range disclosed in WO2005092901 and a titanylphthalocyanine as a CGM has very high sensitivity. However, the titanylphthalocyanine deteriorates the chargeability, and potential of the single-layered photoreceptor due to repeated use, resulting in abnormal images such as background fouling.

In addition, the single-layered photoreceptor tends to produce residual images, and more when using the titanylphthalocyanine as a CGM Because of these reasons, a need exists for a single-layered photoreceptor having high sensitivity, being stably charged and not producing abnormal images such as residual images even after repeatedly used.

SUMMARY OF THE INVENTION

Accordingly, an object of the present invention is to provide a single-layered electrophotographic photoreceptor having high sensitivity, being stably charged and not producing abnormal images such as residual images even after repeatedly used.

Another object of the present invention is to provide an image forming apparatus using the single-layered electrophotographic photoreceptor.

A further object of the present invention is to provide a process cartridge using the single-layered electrophotographic photoreceptor.

These objects and other objects of the present invention, either individually or collectively, have been satisfied by the discovery of an electrophotographic photoreceptor, comprising:

an electroconductive substrate; and a photosensitive layer located overlying the electroconductive substrate, wherein the photosensitive layer is a single-layered layer comprising a charge generation material and an electron transport material having the following formula (1):

(1)

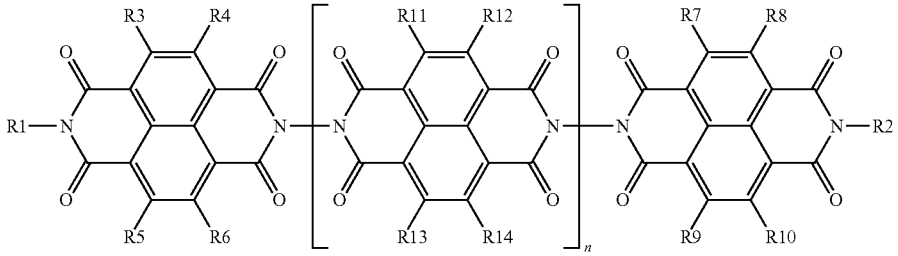

wherein R1 and R2 independently represent a hydrogen atom, and a group selected from the group consisting of substituted or unsubstituted alkyl groups, substituted or unsubstituted cycloalkyl groups and substituted or unsubstituted aralkyl groups; R3, R4, R5, R6, R7, R8, R9, R10, R11, R12, R13 and R14 independently represent a hydrogen atom, a halogen atom, and a group selected from the group consisting of cyano groups, nitro groups, amino groups, a hydroxyl groups, substituted or unsubstituted alkyl groups, substituted or unsubstituted cycloalkyl groups and substituted or unsubstituted aralkyl groups; and n is a repeat unit and represents 0 and an integer of from 1 to 100, and wherein the charge generation materials is a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.6° and 24.0°; and a minimum diffraction peak is observed at 7.3°; no diffraction peak is observed at an angle greater than 7.3° and less than 9.4°; and no diffraction peak other than 24.0° is observed at an angle greater than 23.0° and less than 25.0°, wherein said angles may vary by ±0.2°.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
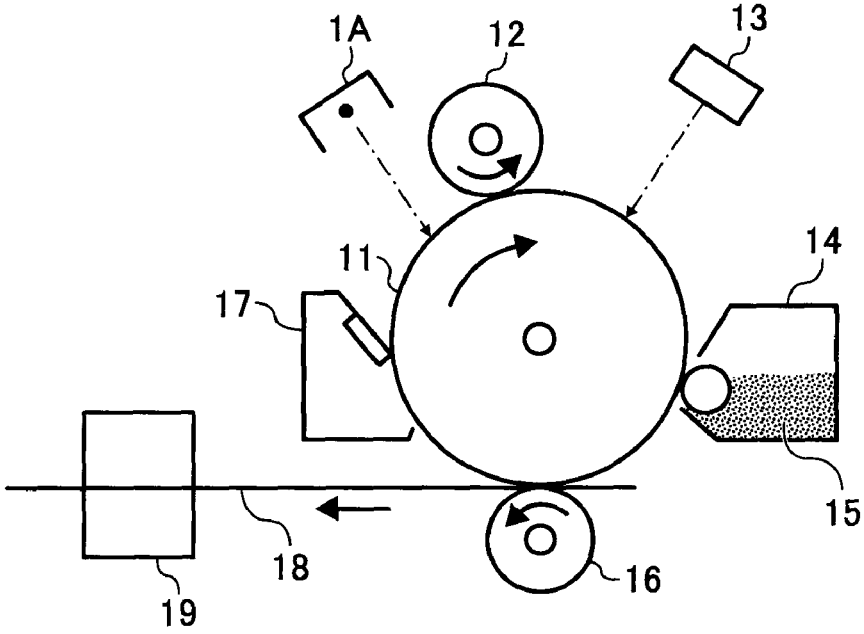
FIG. 1 is a schematic view illustrating a partial cross-section of an embodiment of the image forming apparatus of the present invention.

The present invention provides a single-layered electrophotographic photoreceptor having high sensitivity, being stably charged and not producing abnormal images such as residual images even after repeatedly used.

More particularly, the present invention relates to an electrophotographic photoreceptor, comprising:

an electroconductive substrate; and a photosensitive layer located overlying the electroconductive substrate, wherein the photosensitive layer is a single-layered layer comprising a charge generation material and an electron transport material having the following formula (1):

(1)

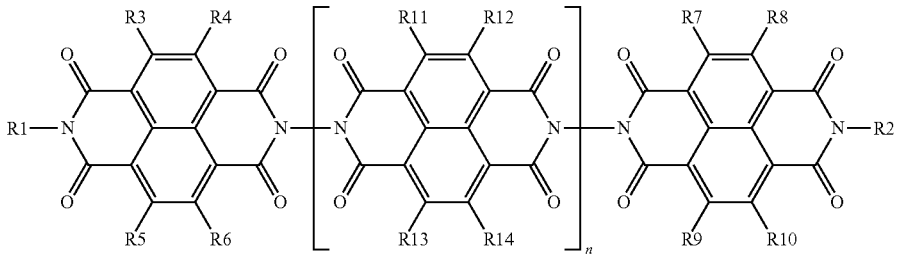

wherein R1 and R2 independently represent a hydrogen atom, and a group selected from the group consisting of substituted or unsubstituted alkyl groups, substituted or unsubstituted cycloalkyl groups and substituted or unsubstituted aralkyl groups; R3, R4, R5, R6, R7, R8, R9, R10, R11, R12, R13 and R14 independently represent a hydrogen atom, a halogen atom, and a group selected from the group consisting of cyano groups, nitro groups, amino groups, a hydroxyl groups, substituted or unsubstituted alkyl groups, substituted or unsubstituted cycloalkyl groups and substituted or unsubstituted aralkyl groups; and n is a repeat unit and represents 0 and an integer of from 1 to 100, and wherein the charge generation materials is a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.6° and 24.0°; and a minimum diffraction peak is observed at 7.3°; no diffraction peak is observed at an angle greater than 7.3° and less than 9.4°; and no diffraction peak other than 24.0° is observed at an angle greater than 23.0° and less than 25.0°, wherein said angles may vary by ±0.2°.

The residual image is due to an uneven image density caused by the following process:

a charged carrier retains on a part irradiated in the irradiating process even after the discharging process; and the part has a lower potential than the circumference because of being irradiated again while having a difference of potential in the following charging process.

The single-layered photoreceptor typically including a CGM evenly in the photosensitive layer basically has a charge generation area evenly therein. Latest digital image forming apparatuses typically use a laser diode (LD) and a light emitting diode (LED) mostly having a near-infrared area wavelength of from 680 to 830 nm. A light source having such a long wavelength emits light to a deep zone of the photosensitive layer and pairs of positive-hole and electron transport materials are evenly formed therein. When the pairs of positive-hole and electron transport materials are evenly formed therein, the difference of charge transportability, constitutional defects, recombination, etc. between the positive-hole and electron transport materials tend to cause interferences the transport thereof and stagnation of the carrier at the irradiated part.

Therefore, both of the positive-hole and electron transport materials need to have sufficient charge transportability in order to prevent the residual image.

Typically, insufficient charge transportability of the electron transport materials cause the stagnation of the carrier. However, the electron transport materials having the formula (1) and very good electron transportability for use in the present invention can form a high-sensitive single-layered photoreceptor having sufficient electron transportability and positive-hole transportability.

However, even such a single-layered photoreceptor having sufficient charge transportability tends to produce residual images due to repeated use.

When the titanylphthalocyanine is used as a CGM, the content thereof cannot be too much in terms of chargeability of a photoreceptor. When the content is too much, the chargeability of the photoreceptor noticeably deteriorates, resulting in production of abnormal images such as background fouling. A photosensitive layer using the titanylphthalocyanine as a CGM has high transmission and generates charge evenly therein. Therefore, the transport of the carriers tends to be interfered due to mutual interaction thereof and residual images due to the carrier stagnation tend to be produced.

The single-layered photoreceptor using a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.6° and 24.0°; and a minimum diffraction peak is observed at 7.3°; no diffraction peak is observed at an angle greater than 7.3° and less than 9.4°; and no diffraction peak other than 24.0° is observed at an angle greater than 23.0° and less than 25.0°, wherein said angles may vary by ±0.2° of the present invention largely lowers in light transmission of its photosensitive layer. Therefore, since charge generates only at the surface vicinity of the photosensitive layer and extra carrier generation therein is prevented, the carrier smoothly transports and the production of residual images is prevented.

When charge generates only at the surface vicinity, a travel distance of the carrier from the charge generation to the deletion of the surface charge becomes shorter in forming an electrostatic latent image. Therefore, a high-resolution latent image faithful to an irradiation can advantageously be formed without receiving an influence of Coulomb repulsion.

Further, the above-mentioned single-layered photoreceptor has good chargeability and hardly produces abnormal images such as background fouling even after repeatedly used.

Hereinafter, the electrophotographic photoreceptor of the present invention will be explained in detail, referring to the drawings.

Figure 7:
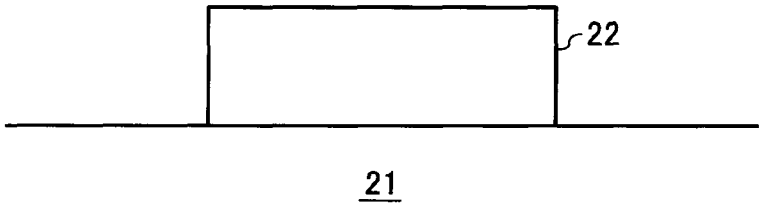
FIG. 7 is a schematic view illustrating a cross-section of an embodiment of layer constitution of the electrophotographic photoreceptor of the present invention.
Figure 8:
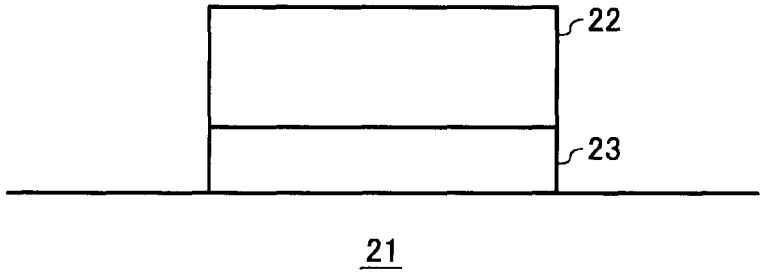
FIG. 8 is a schematic view illustrating a cross-section of another embodiment of layer constitution of the electrophotographic photoreceptor of the present invention.

FIG. 7 is a schematic view illustrating a cross-section of an embodiment of layer constitution of the electrophotographic photoreceptor of the present invention, wherein a photosensitive layer (22) is formed on an electroconductive substrate (21).

Suitable materials as the electroconductive substrate (21) include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum, etc., or a metal oxide such as tinoxides, indiumoxides and the like, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing, etc. can also be used as the substrate.

The photosensitive layer (22) includes at least a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.6° and 24.0°; and a minimum diffraction peak is observed at 7.3°; no diffraction peak is observed at an angle greater than 7.3° and less than 9.4°; and no diffraction peak other than 24.0° is observed at an angle greater than 23.0° and less than 25.0°, wherein said angles may vary by ±0.2° and an electron transport material having the formula (1).

First, the CGM of the present invention will be explained.

The titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.6° and 24.0°; and a minimum diffraction peak is observed at 7.3°; no diffraction peak is observed at an angle greater than 7.3° and less than 9.4°; and no diffraction peak other than 24.0° is observed at an angle greater than 23.0° and less than 25.0°, wherein said angles may vary by ±0.2° (Titanylphthalocyanine A) of the present invention can be obtained by subjecting a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; no diffraction peak is observed at an angle greater than 7.30 and less than 9.4°, wherein said angles may vary by ±0.2° (Titanylphthalocyanine B) to a crystal conversion.

Specifically, a large shearing strength is applied to the titanylphthalocyanine B in an organic solvent to obtain the titanylphthalocyanine A.

Typically, it is known that a titanylphthalocyanine having a maximum diffraction peak at 27.2° tends to change a crystal having a maximum diffraction peak at 26.3°.

In the present invention, a titanylphthalocyanine having a maximum diffraction peak at 26.3° is not preferably used because the sensitivity of the resultant photosensitive layer deteriorates.

Ketones such as cyclohexanone and methyl ethyl ketone and esters such as ethylacetate and n-butylacetate are preferably used as the organic solvent for the crystal conversion of the titanylphthalocyanine of the present invention because the resultant titanylphthalocyanine is not likely to have a peak at 26.3°.

Particularly, a mixed solvent of tetrahydrofuran and water is more preferably used because the resultant titanylphthalocyanine hardly has a peak at 26.3°.

The mixing ratio (THF/water) of tetrahydrofuran (THF) to water is preferably from 99/1 to 80/20. When an amount of water is too small, the resultant titanylphthalocyanine is not likely to have a peak at 26.3°. When too much, the titanylphthalocyanine is not stably dispersed.

Conventional dispersers such as a ball mill, a beads mill, a vibration mill, a sand mill and an ultrasonic mill can be used for applying a large shearing strength.

The dispersion media diameter needs to be smaller or dispersion time needs to be longer to obtain the titanylphthalocyanine of the present invention. The dispersing conditions are preferably determined with a preliminary experiment because of depending the state of a titanylphthalocyanine before subjected to a crystal conversion such as sizes and stiffness of the powder.

Thus, the titanylphthalocyanine of the present invention can be prepared in the state of a dispersion liquid. Further, the dispersion liquid may be filtered, classified and dried to obtain a powder of the titanylphthalocyanine.

The titanylphthalocyanine can be subjected to a crystal conversion just upon application of mechanical strength without using an organic solvent, however, a CGM is preferably dispersed in an organic solvent to prepare a photosensitive layer coating liquid in advance, and it is preferable that the crystal conversion and the preparation of the dispersion liquid are both performed in an organic solvent.

Next, the CTM will be explained.

The electron transport material having the formula (1) has the following structural skeleton:

(1)

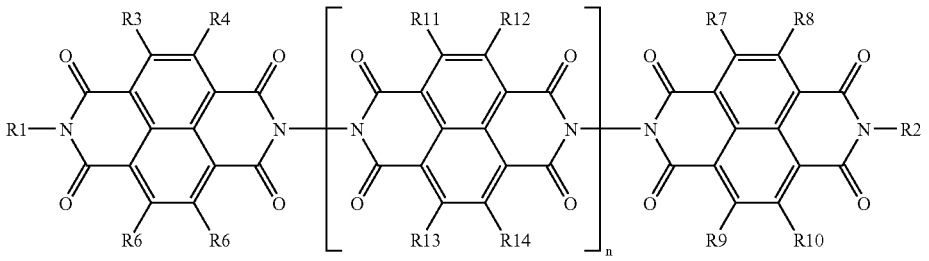

wherein R1 and R2 independently represent a hydrogen atom, and a group selected from the group consisting of substituted or unsubstituted alkyl groups, substituted or unsubstituted cycloalkyl groups and substituted or unsubstituted aralkyl groups; R3, R4, R5, R6, R7, R8, R9, R10, R11, R12, R13 and R14 independently represent a hydrogen atom, a halogen atom, and a group selected from the group consisting of cyano groups, nitro groups, amino groups, a hydroxyl groups, substituted or unsubstituted alkyl groups, substituted or unsubstituted cycloalkyl groups and substituted or unsubstituted aralkyl groups; and n is a repeat unit and represents 0 and an integer of from 1 to 100.

The substituted or unsubstituted alkyl groups has 1 to 25, preferably 1 to 10 carbon atoms. Specific examples thereof include linear alkyl groups such as a methyl group, an ethyl group, a n-propyl group, a n-butyl group, a n-pentyl group, a n-hexyl group, a n-peptyl group, a n-octyl group, a n-nonyl group and a n-decyl group; branched alkyls such as an isopropyl group, a s-butyl group, a t-butyl group, a methylpropyl group, a dimethylpropyl group, an ethylpropyl group, a diethylpropyl group, a methylbutyl group, a dimethylbutyl group, a methylpentyl group, a dimethylpentyl group, a methylhexyl group and a dimethylhexyl group; an alkoxyalkyl group; a monoalkylaminoalkyl group; a dialkylaminoalkyl group; a halogen-substituted alkyl group; an alkylcarbonylalkyl group; a carboxyalkyl group; an alkanoyloxyalkyl group; an aminoalkyl group; an alkyl group substituted with a carboxyl group, which may be esterified; an alkyl group substituted with a cyano group, etc. The substitution sites of these substituents are not particularly limited, and a functional group, wherein a part of carbon atoms of an alkyl group is substituted with a heteroatom such as N, O and S, is included in the substituted alkyl groups.

The substituted or unsubstituted cycloalkyl groups are cycloalkyl rings having 3 to 25, preferably 3 to 10 carbon atoms. Specific examples thereof include congeneric rings such as cyclopropane and cyclodecane; cycloalkyl rings having an alkyl substituent such as methylcyclopentane, dimethylcyclopentane, methylcyclohexne, trimethylcyclohexne, tetramethylcyclohexne, ethylcyclohexne, diethylcyclohexne and t-butylcyclohexne; an alkoxyalkyl group; a monoalkylaminoalkyl group; a dialkylaminoalkyl group; a halogen-substituted alkyl group; an alkylcarbonylalkyl group; a carboxyalkyl group; an alkanoyloxyalkyl group; an aminoalkyl group; a halogen group; an amino group; a carboxyl group which may be esterified; a cycloalkyl group substituted with a cyano group, etc. The substitution sites of these substituents are not particularly limited, and a functional group, wherein a part of carbon atoms of an cycloalkyl group is substituted with a heteroatom such as N, O and S, is included in the substituted cycloalkyl groups.

The substituted or unsubstituted aralkyl groups are substituted or unsubstituted alkyl groups substituted with an aromatic ring, and preferably has 6 to 14 carbon atoms. Specific examples thereof include a benzyl group, a perfluolophenylethyl group, a 1-phenylethyl group, a 2-phenylethyl group, a tert-phenylethyl group, a dimethylphenylethyl group, a diethylphenylethyl group, a t-butylphenylethyl group, a 3-phenylpropyl group, a 4-phenylbutyl group, a 5-phenylpentyl group, a 6-phenylhexy group, a benzhydryl group, a trityl group, etc.

Specific examples of the halogen group include a fluoro group, a chloro group, a bromo group and an iodine group.

The electron transport material having the formula (1) is mostly synthesized by the following two methods:

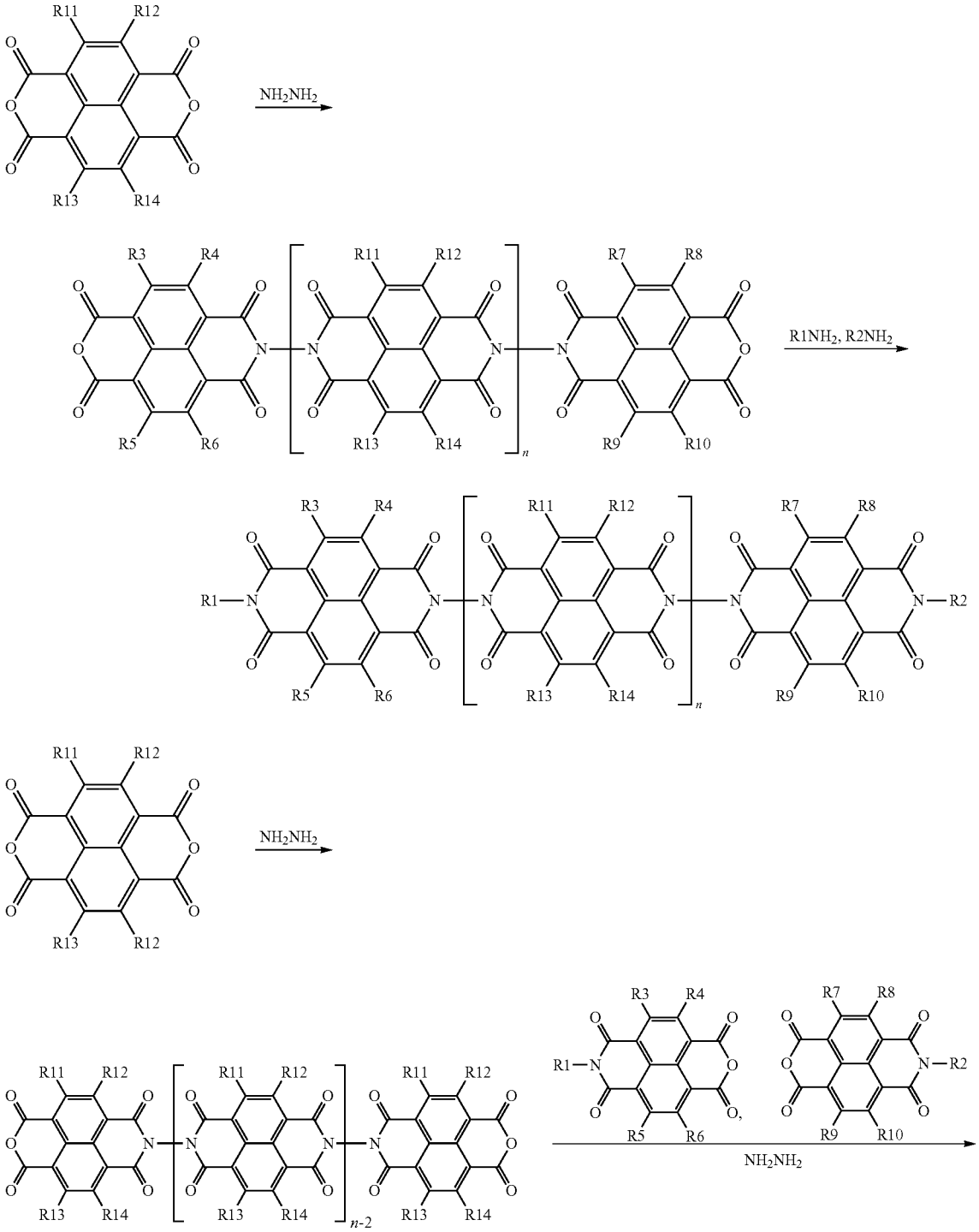

-continued

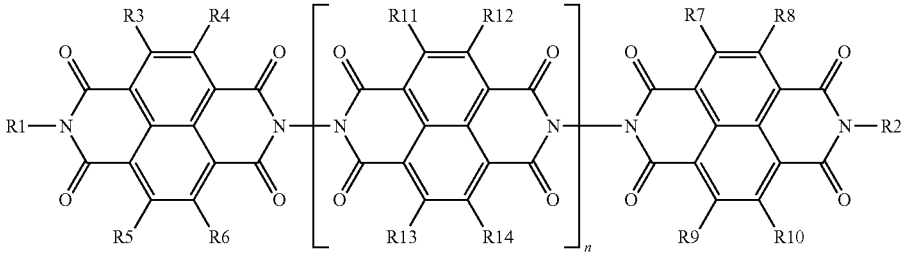

Specific examples of methods of preparing the electron transport material having the formula (1) include the following method.

Namely, a naphthalenecarboxylic acid is synthesized by the following reaction formula, e.g., U.S. Pat. No. 6,794,102 Industrial Organic Pigments 2nd edition, VCH, 485 (1997):

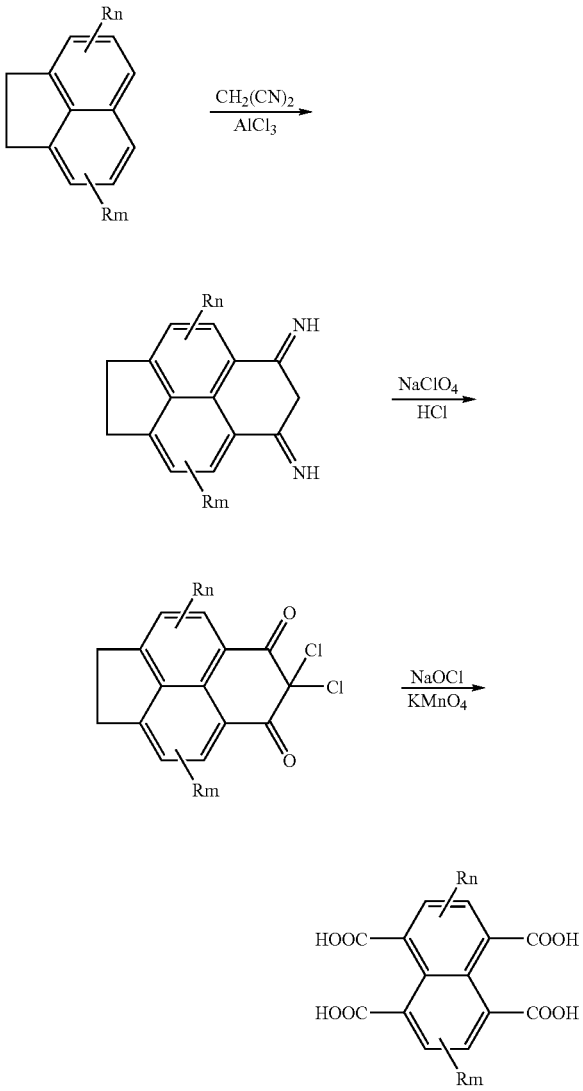

wherein Rn represents R3, R4, R7 and R8; and Rm represents R5, R6, R9 and R10.

The electron transport material having the formula (1) can be synthesized by known methods. Specific examples thereof include a monoimidizing method of reacting a naphthalene carboxylic acid or its anhydride with amines and a method of controlling pH of a naphthalene carboxylic acid or its anhydride with a buffer solution and reacting the naphthalene carboxylic acid or its anhydride with diamines. The monoimidizing is performed without a solvent or under the presence of a solvent. Specific examples of the solvent include benzene, toluene, xylene, chloronaphthalene, acetic acid, pyridine, methylpyridine, dimethylformamide, dimethylacetoamide, dimethylethyleneurea, dimethylsulfoxide, etc., which do not react with a material or a product at a temperature of from 50 to 250° C. A buffer solution prepared by mixing a basic aqueous solution such as lithium hydroxide and kalium hydroxide with an acid such as a phosphoric acid is used to control pH. A carboxylic acid derivative prepared by reacting a carboxylic acid with amines or diamines is dehydrated without a solvent or under the presence of a solvent. Specific examples of the solvent include benzene, toluene, xylene, chloronaphthalene, bromonaphthalene, acetic acid anhydride, etc., which do not react with a material or a product at a temperature of from 50 to 250° C. Either of the reactions can be performed without a catalyst or under the presence of a catalyst, e.g., dehydrating agents such as molecular sieves, a benzene sulfonic acid and a p-toluene sulfonic acid can be used.

In the formula (1), n is a repeat unit and represents 0 and an integer of from 1 to 100. n is determined by a weight-average molecular weight (Mw). Namely, the electron transport material has a molecular weight distribution. When n is greater than 100, the solubility in solvents deteriorates. Particularly, a dimer when n is 0 is preferably used because of having good solubility and photosensitivity.

Even oligomers have good charge transportability when substituents of R1 and R2 are properly selected. When n is varied, wide variety of naphthalene carboxylic acid derivatives from oligomers to polymers are synthesized.

When oligomers having a low molecular weight is synthesized stepwise, monodispersed compounds can be obtained. Polymers having a high molecular weight is synthesized to electron transport mixtures having a molecular weight distribution.

Preferred embodiments of the electron transport material having the formula (1) include the following materials, but are not limited thereto.

| No. | 構造式 |
|---|---|
| 1-1 | 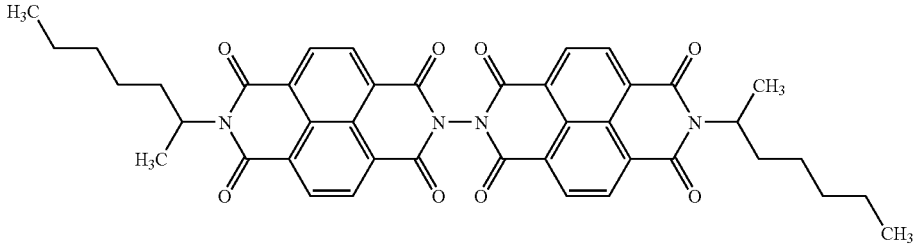 |
| 1-2 | 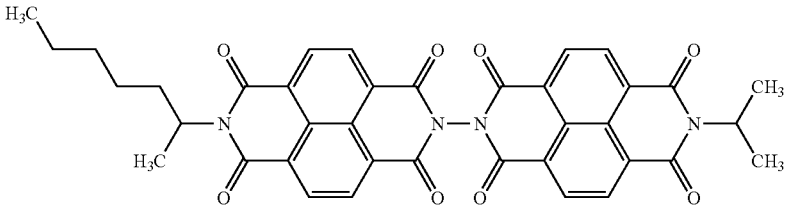 |
| 1-3 | 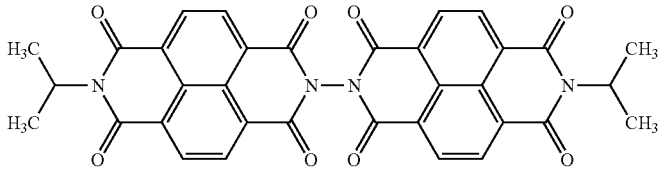 |
| 1-4 | 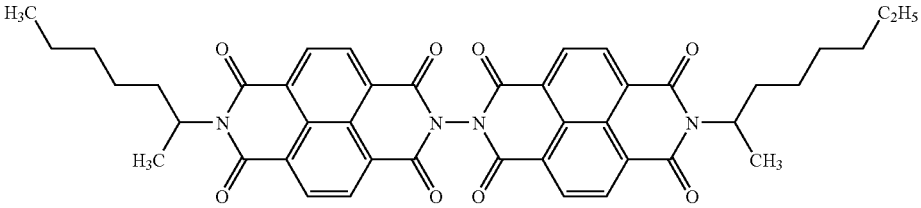 |
| 1-5 | 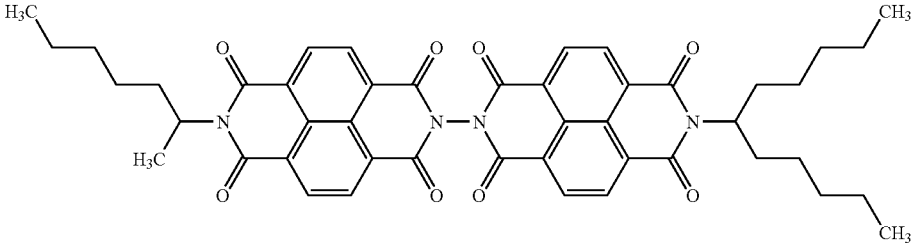 |
| 1-6 | 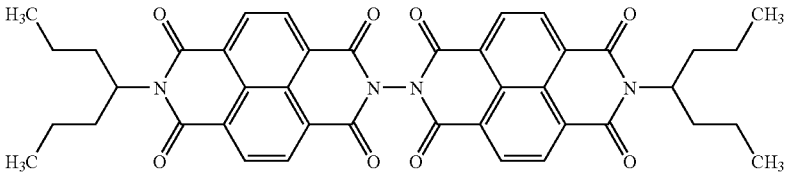 |
| 1-7 | 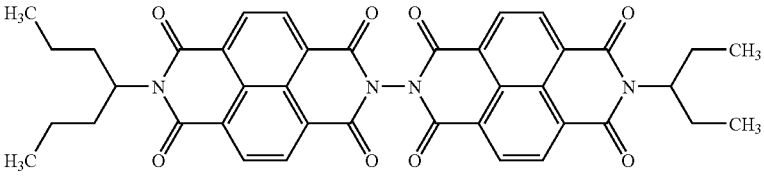 |

-continued
| No. | 構造式 |
|---|---|
| 1-8 | 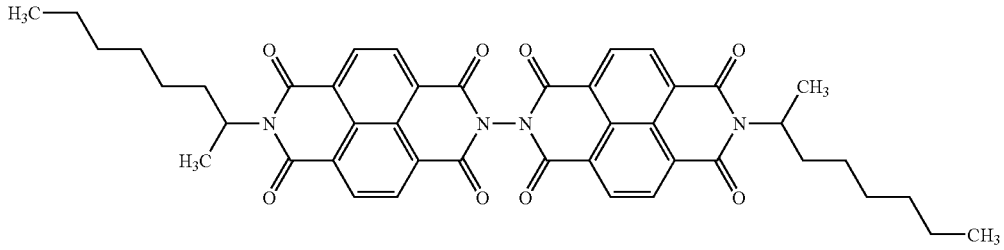 |
| 1-9 | 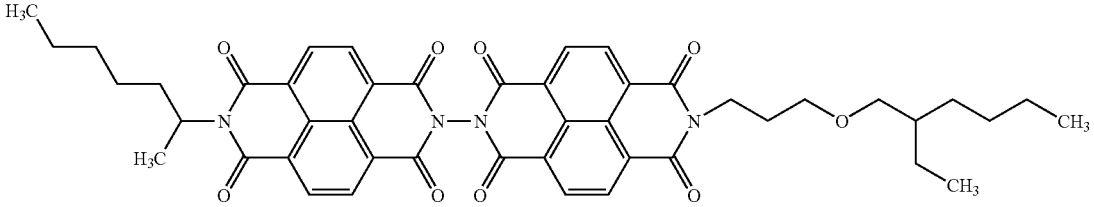 |
| 1-10 | 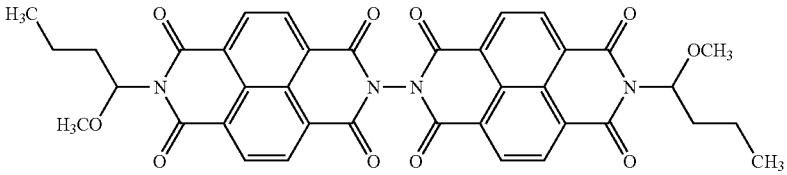 |
| 1-11 | 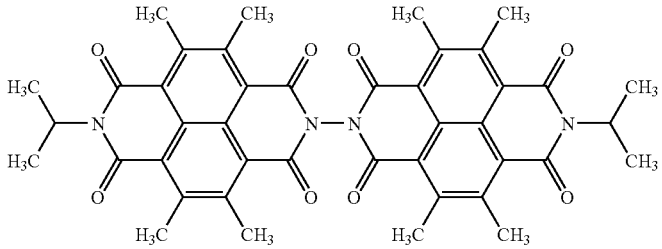 |
| 1-12 | 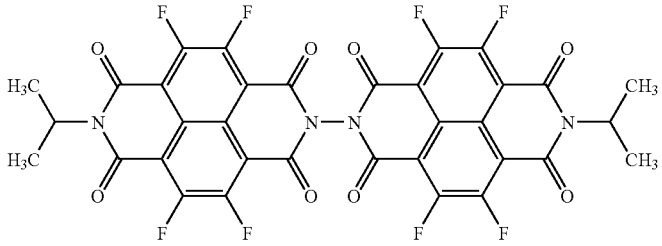 |
| 1-13 | 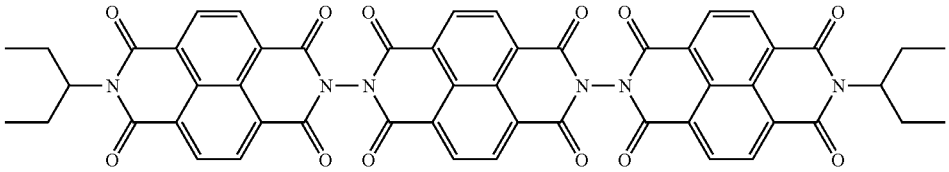 |
| 1-14 | 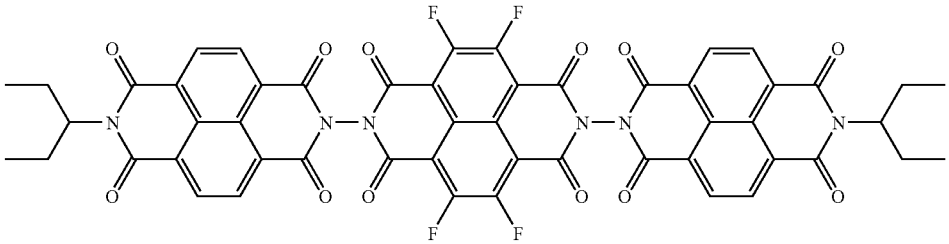 |

In the present invention, the electron transport material having the formula (1) is essentially used. In addition, known electron transport materials (acceptors) and positive-hole transport materials (donors) can be used together.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives, etc.

These electron transport materials can be used alone or in combination.

Electron donating materials are preferably used as the positive-hole transport materials.

Specific examples of the positive-hole transport materials include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, thiophene derivatives, etc.

These positive-hole transport materials can be used alone or in combination.

Specific examples of polymer binders for use in the photosensitive layer include, but are not limited to, known thermoplastic resins or thermosetting resins such as polystyrene, a styrene-acrylonitrile copolymer, a styrene-butadiene copolymer, a styrene-maleic anhydride copolymer, polyester, polyvinylchloride, a vinylchloride-vinylacetate copolymer, polyvinyl acetate, polyvinylidenechloride, polyarylate, a phenoxyresin, polycarbonate, a cellulose acetate resin, an ethyl cellulose resin, a polyvinyl butyral resin, a polyvinyl formal resin, polyvinyl toluene, poly-N-vinyl carbazole, an acrylic resin, a silicone resins, a fluorine-containing resin, an epoxy resin, a melamine resin, a urethane resin, a phenolic resin and an alkyd resin, etc.

Among the polymer binders, the polycarbonate resin is preferably used in terms of layer quality.

A casting method is preferably used to form a photosensitive layer. A CGM, a CTM, a binder resin and other optional components are dispersed or dissolved in a proper solvent to prepare a coating liquid. The concentration of the liquid is adjusted and the liquid is coated by the casting method.

In order to uniformly disperse the CGM in the photosensitive layer (coating liquid), it is preferable that the CGM is dispersed optionally with a binder resin by a ball mil, an attritor or a sand mill, etc. in a solvent such as tetrahydrofuran, cyclohexanone, dioxane, dichloroethane and butanone to prepare a dispersion liquid in advance.

The dispersion liquid is coated by a dip coating method, a spray coating method, a bead coating method, etc.

Specific examples of solvents used for preparing a photosensitive layer coating liquid include ketones such as methyl ethyl ketone, acetone, methyl isobutyl ketone and cyclohexanone; ethers such as dioxane, tetrahydrofuran and ethyl cellosolve; aromatic series such as toluene and xylene; halogens such as chlorobenzene and dichloromethane; and esters such as ethylacetate and butylacetate. These solvents can be used alone or in combination.

The photosensitive layer preferably includes a CGM in an amount of from 0.1 to 30% by weight, and more preferably from 0.5 to 10% by weight. The photosensitive layer preferably includes an electron transport material in an amount of from 5 to 300 parts by weight, and more preferably from 10 to 150 parts by weight per 100 parts by weight of the binder resin. However, the electron transport material preferably include the electron transport material having the formula (1) in an amount of from 50 to 100% by weight. The photosensitive layer preferably includes a positive-hole transport material in an amount of from 5 to 300 parts by weight, and more preferably from 20 to 150 parts by weight per 100 parts by weight of the binder resin. The photosensitive layer preferably includes the electron transport material and the positive-hole transport material in total in an amount of from 20 to 300 parts by weight, and more preferably from 30 to 200 parts by weight per 100 parts by weight of the binder resin.

In addition, the photosensitive layer may optionally include a low-molecular-weight compound and a leveling agent such as an antioxidant, a plasticizer, a lubricant and an UV absorber. The photosensitive layer preferably includes the low-molecular-weight compound in an amount of from 0.1 to 50 parts by weight, and more preferably from 0.1 to 20 parts by weight per 100 parts by weight of the binder resin. The photosensitive layer preferably includes the leveling agent in an amount of from 0.001 to 5 parts by weight per 100 parts by weight of the binder resin.

The photosensitive layer preferably has thickness of from 5 to 40 μm, and more preferably from 15 to 35 μm.

An undercoat layer (23) may be formed between an electroconductive substrate (21) and a photosensitive layer (22) in the electrophotographic photoreceptor of the present invention. The undercoat layer is formed for the purpose of improving adherence of the photosensitive layer to the substrate, improving coating capability of the above layer, decreasing the residual potential and preventing charge injection from the substrate.

The undercoat layer includes a resin as a main constituent. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and hardening resins capable of forming a three-dimensional network such as polyurethane resins, melamine resins, alkyd-melamine resins, epoxy resins, etc.

The undercoat layer may include a fine powder of metal oxides such as titaniumoxide, silica, alumina, zirconium oxide, tin oxide and indium oxide to prevent occurrence of moiré in the recorded images and to decrease residual potential of the photoreceptor. The undercoat layer can be formed by using a proper solvent and a conventional coating method.

Further, a metal oxide layer formed by, e.g., a sol-gel method using a silane coupling agent, titanium coupling agent or a chromium coupling agent, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is can be used as the undercoat layer.

The undercoat layer preferably has a thickness of from 0.1 to 10 μm, and more preferably from 1 to 5 μm.

FIG. 1 is a schematic view illustrating a partial cross-section of an embodiment of the image forming apparatus of the present invention, and the following modified embodiments belong to the present invention as well.

In FIG. 1, a photoreceptor (11) satisfies the requirements of the present invention. The photoreceptor (11) has the shape of a drum, and may have the shape of a sheet or an endless belt.

Known charges such as a corotron charger, a scorotron charger, a solid state charger and a charging roller are used as a charger (12). A charger contacting or located close to a photoreceptor is preferably used in terms of reducing the power consumption. Particularly, the charger located close to a photoreceptor with a suitable gap therebetween is more preferably used to prevent the charger (12) from being contaminated.

As a transferee (16), the above-mentioned chargers can typically be used, and a combination of a transfer charger and a separation charger is preferably used.

Suitable light sources for use in an irradiator (13) and a discharger (1A) include general light-emitting materials such as fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

When a toner image formed on the photoreceptor by an image developer (14) is transferred onto an image receiving medium (18), all of the toner image is not transferred thereto, and a residual toner remains on the surface of the photoreceptor. The residual toner is removed from the photoreceptor by a cleaner (17). The cleaner includes a cleaning blade made of a rubber and brushes such as a fur brush and a mag-fur brush.

Figure 2:
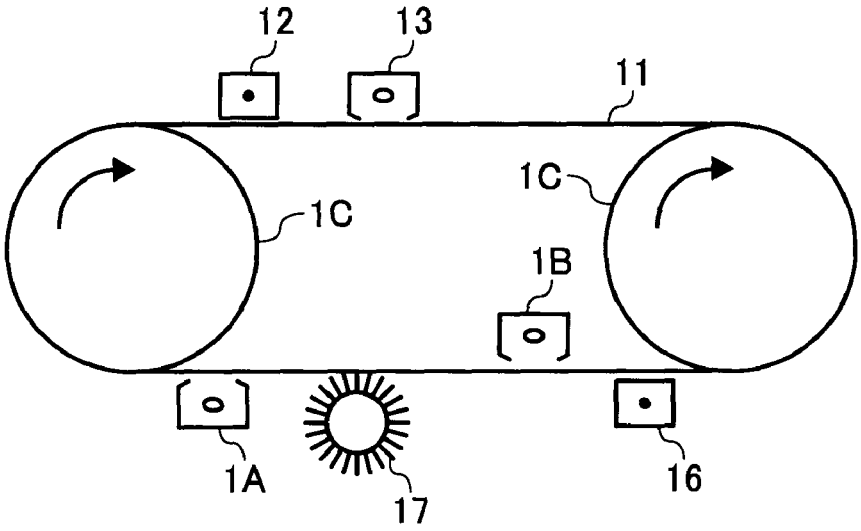
FIG. 2 is a schematic view illustrating a partial cross-section of another embodiment of the image forming apparatus of the present invention.

FIG. 2 is a schematic view illustrating a partial cross-section of another embodiment of the image forming apparatus of the present invention. In FIG. 2, a photoreceptor (11) satisfies the requirements of the present invention, and has the shape of an endless belt.

The photoreceptor (11) is driven by a driver (1C), and it is repeated that a charger (12) charges the photoreceptor, an irradiator (13) irradiates the photoreceptor with imagewise light to form an electrostatic latent image thereon, an image developer (not shown) develops the electrostatic latent image to form a toner image thereon, a transferer (16) transfers the toner image onto a recording medium, a pre-cleaning irradiator (1B) irradiates the photoreceptor before cleaned, a cleaner (17) cleans the photoreceptor and a discharger (1A) discharges the photoreceptor. In FIG. 2, the pre-cleaning irradiator (1B) irradiates the photoreceptor through a translucent substrate thereof.

In FIG. 2, the pre-cleaning irradiator (1B) may directly irradiates a photosensitive layer of the photoreceptor. In addition, the imagewise light and discharging light may be irradiated through the translucent substrate. Other than the imagewise light irradiation, pre-cleaning irradiation and discharging light irradiation, a pre-transfer irradiation and an irradiation before the imagewise light irradiation may be performed on the photoreceptor.

Figure 3:
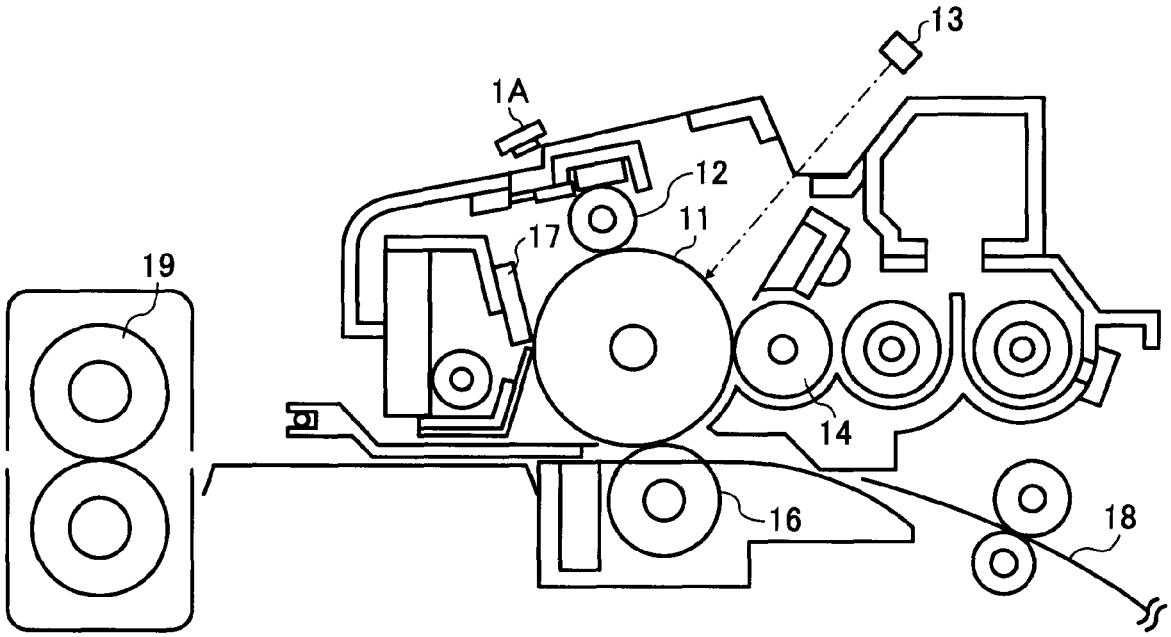
FIG. 3 is a schematic view illustrating a partial cross-section of an embodiment of the process cartridge of the present invention.

The above-mentioned image forming units may be fixedly set in a copier, a facsimile or a printer. However, the image forming units may be set therein as a process cartridge. FIG. 3 illustrates an embodiment of the process cartridge, and not limited thereto. The process cartridge means an image forming unit (or device) including at least a photoreceptor (11) and one of a charger (12), an imagewise light irradiator (13), an image developer (14), an image transferer (16), a cleaner (17) and a discharger (1A). The photoreceptor (11) is a drum-shaped photoreceptor satisfying the requirements of the present invention, and may have the shape a sheet or an endless belt.

Figure 4:
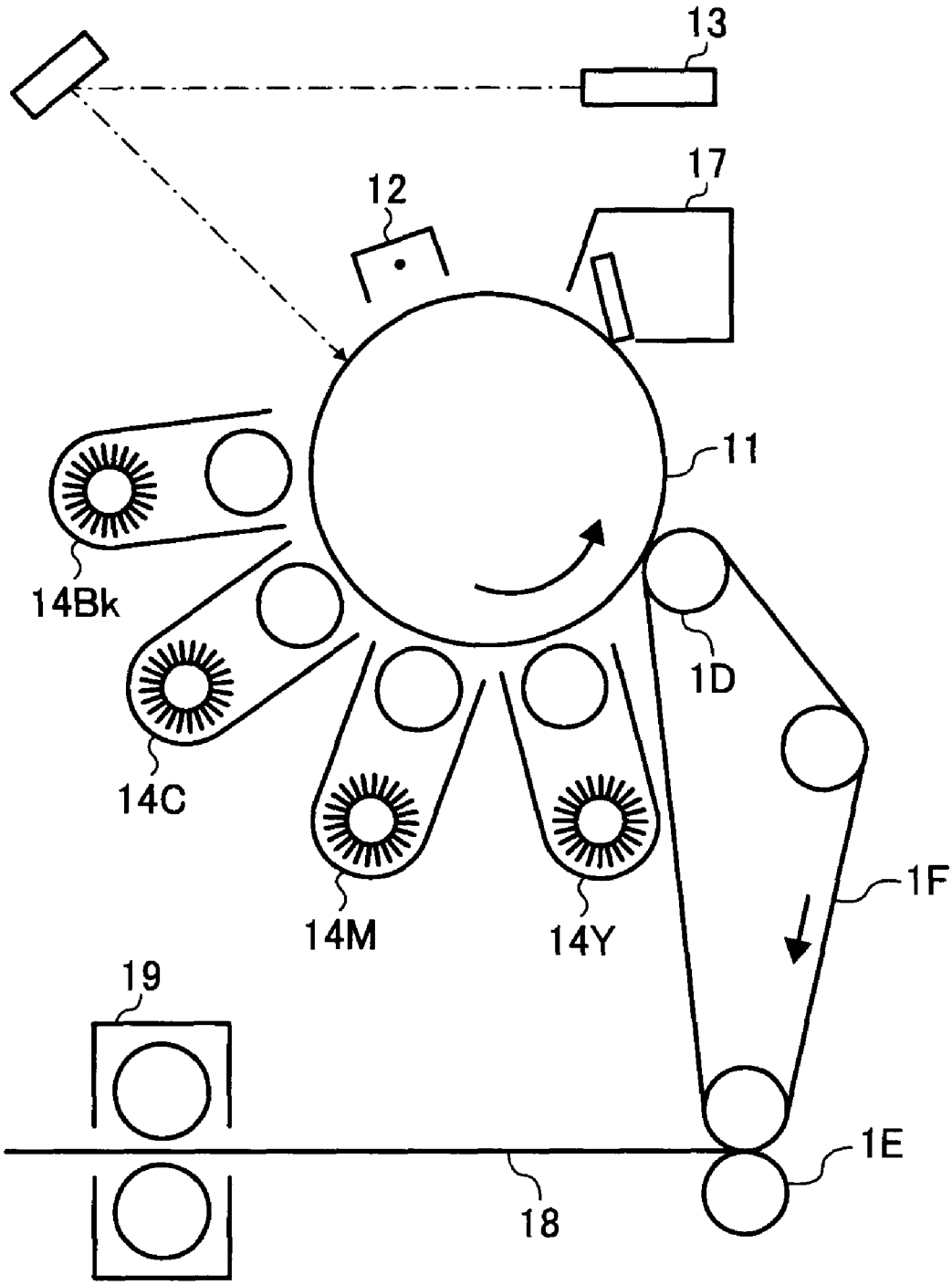
FIG. 4 is a schematic view illustrating a partial cross-section of a further embodiment of the image forming apparatus of the present invention.

FIG. 4 is a schematic view illustrating another embodiment of the image forming apparatus of the present invention, wherein a charger (12), an irradiator (13), image developers (14Bk, 14C, 14M and 14Y) for each color toner (Bk, C, M and Y), an intermediate transfer belt (1F) as an intermediate transferer and a cleaner (17) are located around a photoreceptor (11).

The photoreceptor (11) is an electrophotographic photoreceptor satisfying the requirements of the present invention. The image developers (14Bk, 14C, 14M and 14Y) can independently be controlled and only the image developer forming an image works. Toner image formed on the photoreceptor (11) is transferred onto the intermediate transfer belt (1F) by a first transferer (1D) located inside the intermediate transfer belt (1F). The first transferer (1D) is located contactable to and separable from the photoreceptor (11), and contacts the intermediate transfer belt (1F) to the photoreceptor (11) only when transferring a toner image. Each color toner image overlaid on the intermediate transfer belt (1F) is transferred onto the image receiving medium (18) together by a second transferer (1E) and fixed thereon by a fixer (19). The second transferer (1E) is located contactable to and separable from intermediate transfer belt (1F), and contacts the intermediate transfer belt (1F) only when transferring a toner image.

An electrophotographic image forming apparatus using a transfer drum sequentially transfers each color toner image on a transfer material electrostatically absorbed onto the transfer drum and cannot transfer toner images onto a thick paper. However, the image forming apparatus in FIG. 4 overlaps each color toner image on the intermediate transfer belt (1F) and does not limit the transfer material. Such an intermediate transferer can be used not only in the image forming apparatus in FIG. 4 but also the image forming apparatuses in FIGS. 1, 2 and 3, and image forming apparatuses in FIGS. 5 and 6 mentioned later.

Figure 5:
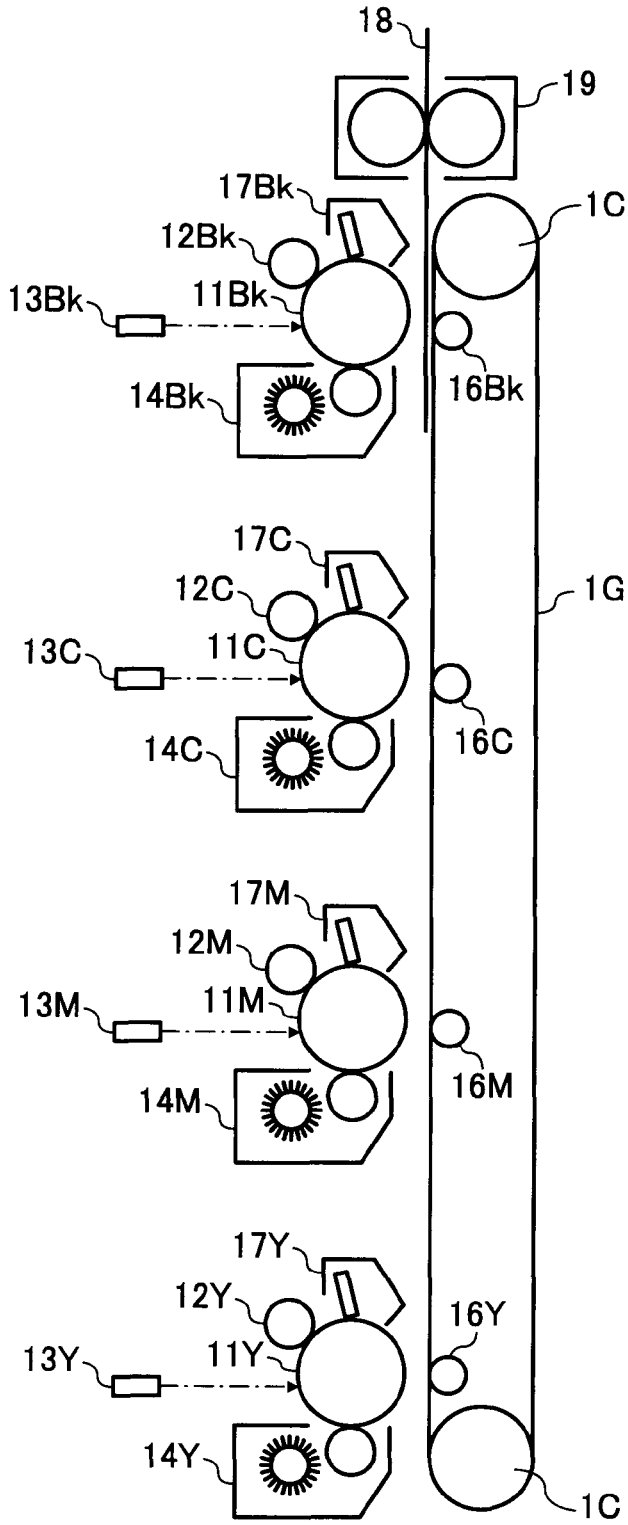
FIG. 5 is a schematic view illustrating a partial cross-section of another embodiment of the image forming apparatus of the present invention.
Figure 6:
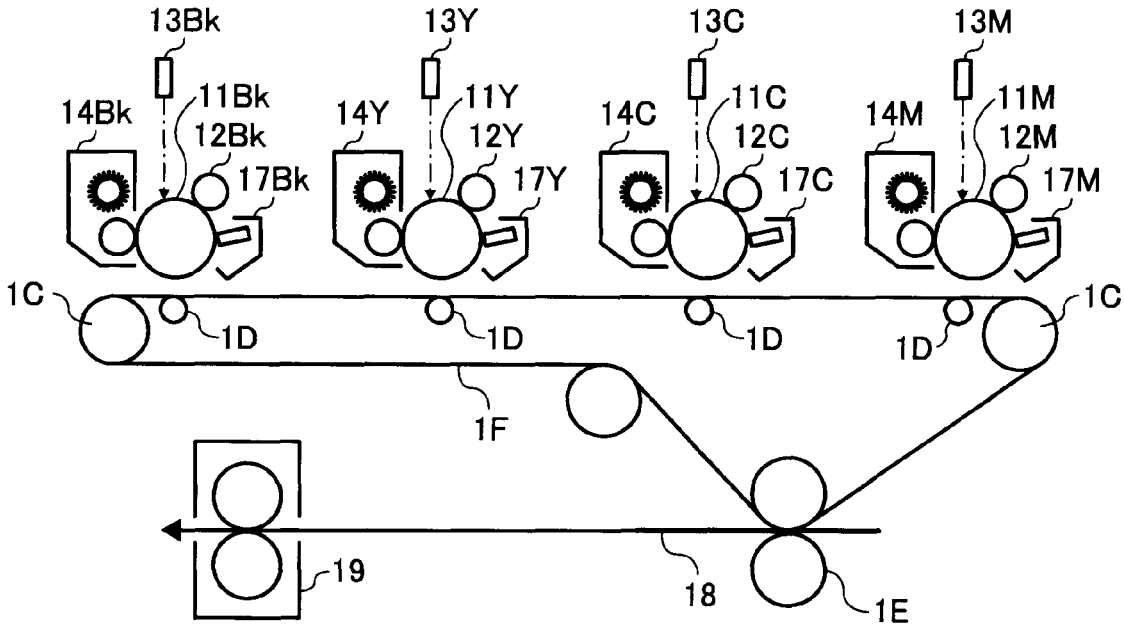
FIG. 6 is a schematic view illustrating a partial cross-section of a further embodiment of the image forming apparatus of the present invention.

FIGS. 5 and 6 are schematic views illustrating partial cross-sections of embodiments of full-color image forming apparatuses of the present invention, using toners of four colors, i.e., yellow (Y), magenta (M), cyan (C) and black (Bk) and including photoreceptors (11Y, 1M, 11C and 11Bk) for each color, which satisfy the requirements of the present invention. Chargers (12Y, 12M, 12C and 12Bk), irradiators (13Y, 13M, 13C and 13Bk), image developers (14Y, 14M, 14C and 14Bk), cleaners (17Y, 17M, 17C and 17Bk), etc. are located around the photoreceptors (11Y, 11M, 11C and 11Bk) respectively. A transfer belt (1G) as a transfer material bearer contactable to and separable from the photoreceptors (11Y, 1M, 11C and 11Bk) in line is hung on a driver (1C). Transferers (16Y, 16M, 16C and 16Bk) are located facing the photoreceptors (11Y, 11M, 11C and 11Bk) across the transfer belt (1G).

The above-mentioned image forming units may be fixedly set in a copier, a facsimile or a printer. However, the image forming units may be set therein as a process cartridge. The process cartridge means an image forming unit (or device) including at least a photoreceptor and one of a charger, an imagewise light irradiator, an image developer, an image transferer, a cleaner and a discharger.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of Titanylphthalocyanine

A pigment was prepared in accordance with Japanese Published Unexamined Patent Application No. 2001-19871.

Namely, at first 29.2 g of 1,3-diiminoisoindoline and 200 ml of sulfolane were mixed. Then 20.4 g of titanium tetrabutoxide was dropped into the mixture under a nitrogen gas flow. The mixture was then heated to 180° C. and a reaction was performed for 5 hours at a temperature of from 170 to 180° C. while agitating. After the reaction, the reaction product was cooled, followed by filtering. The thus prepared wet cake was washed with chloroform until the cake colored blue. Then the cake was washed several times with methanol, followed by washing several times with hot water heated to 80° C. and drying. Thus, a crude titanylphthalocyanine was prepared. One part of the thus prepared crude titanylphthalocyanine was dropped into 20 parts of concentrated sulfuric acid to be dissolved therein. The solution was dropped into 100 parts of ice water while stirred, to precipitate a titanylphthalocyanine pigment. The pigment was obtained by filtering. The pigment was washed with ion-exchange water having a pH of 7.0 and a specific conductivity of 1.0 μS/cm until the filtrate became neutral. In this case, the pH and specific conductivity of the filtrate was 6.8 and 2.6 μS/cm. Thus, an aqueous paste of a titanylphthalocyanine pigment was obtained. Forty (40) grams of the thus prepared aqueous paste of the titanylphthalocyanine pigment, which has a solid content of 15% by weight, was added to 200 g of tetrahydrofuran (THF) and the mixture was stirred for about 4 hours. The weight ratio of the titanylphthalocyanine pigment to the crystal changing solvent (i.e., THF) was 1/33. Then the mixture was filtered and the wet cake was dried to prepare a titanylphthalocyanine powder.

Figure 9:
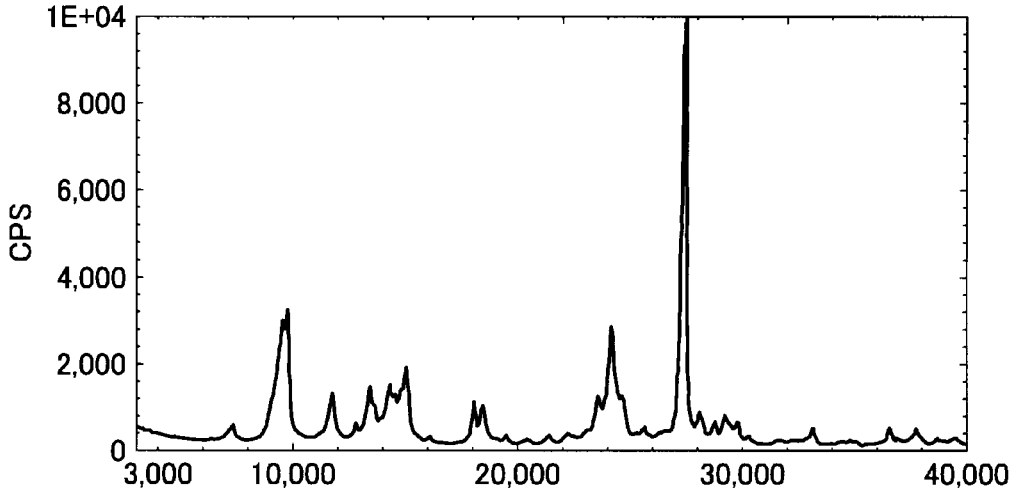
FIG. 9 is a X-ray diffraction spectrum of a titanylphthalocyanine crystal prepared in Examples.

When the thus prepared titanylphthalocyanine powder was subjected to the X-ray diffraction analysis under the following conditions, the titanylphthalocyanine powder had an X-ray diffraction spectrum such that a maximum peak is observed at a Bragg (2θ) angle of 27.2°; main peaks are observed at 9.4°, 9.6° and 24.0°; and a minimum diffraction peak is observed at 7.3°; no diffraction peak is observed at an angle greater than 7.3° and less than 9.4°, wherein said angles may vary by ±0.2°. The X-ray diffraction spectrum thereof is illustrated in FIG. 9.

X-ray tube: Cu
X-ray used: Cu—Kα having a wavelength of 1.542 Å
Voltage: 50 kV
Current: 30 mA
Scanning speed: 2°/min
Scanning range: 3° to 40°
Time constant: 2 seconds

Titanylphthalocyanine Crystal Conversion and Preparation of Dispersion Liquid

Pigment Dispersion Preparation Example 1

The following materials were dispersed in a sample bottle having a capacity of 30 cc together with PSZ balls having a diameter of 2 mm with a marketed disperser at 1,500 rpm for 1 hr to prepare a pigment dispersion 1.

| | |
|---|---|
| Titanylphthalocyanine prepared as above | 3 |
| Tetrahydrofuran | 92 |
| Ion-exchanged water | 5 |

Figure 10:
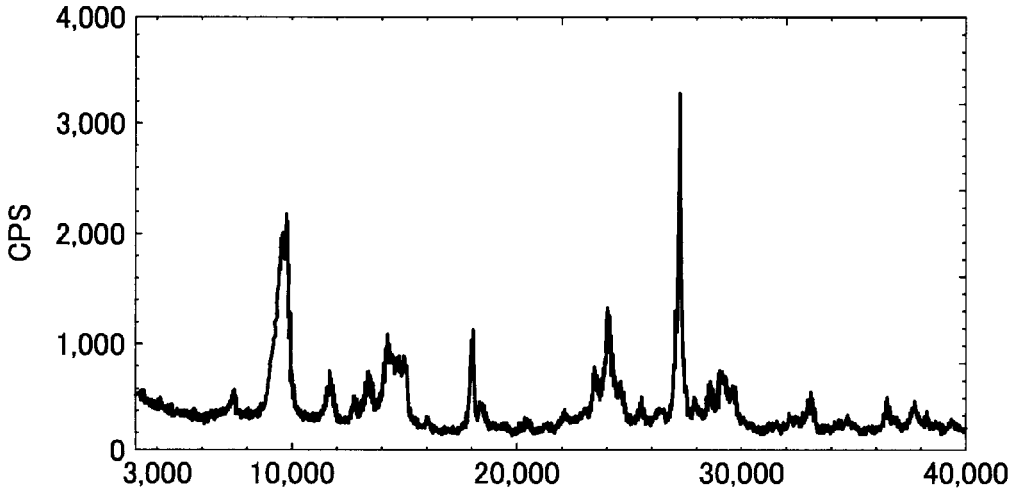
FIG. 10 is a X-ray diffraction spectrum of a titanylphthalocyanine crystal in pigment dispersion liquid 1 in Comparative Example 1.

When the thus prepared titanylphthalocyanine powder was subjected to the X-ray diffraction analysis under the same conditions as above, titanylphthalocyanine powder had an X-ray diffraction spectrum, wherein main diffraction peaks are observed at a Bragg (2θ) angle of 7.3°, 9.4°, 9.6°, 24.0° and 27.2°; and diffraction peaks are observed at 23.5° and 24.5° other than 24.0° at an angle greater than 23.0° and less than 25.0°, wherein said angles may vary by ±0.2°, which was different from the titanylphthalocyanine of the present invention. The X-ray diffraction spectrum thereof is illustrated in FIG. 10.

Pigment Dispersion Preparation Example 2

The procedure for preparation of the pigment dispersion 1 was repeated except for changing the PSZ balls to those having a diameter of 0.2 mm to prepare a pigment dispersion 2.

Figure 11:
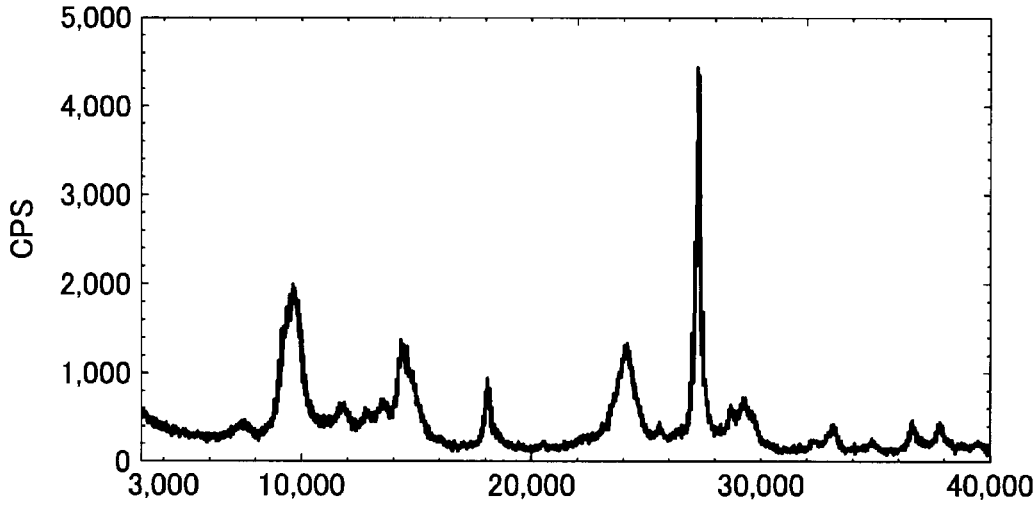
FIG. 11 is a X-ray diffraction spectrum of a titanylphthalocyanine crystal in pigment dispersion liquid 2 used in Examples.

When the thus prepared titanylphthalocyanine powder was subjected to the X-ray diffraction analysis under the same conditions as above, titanylphthalocyanine powder had an X-ray diffraction spectrum, wherein main diffraction peaks are observed at a Bragg (2θ) angle of 7.3°, 9.6°, 24.0° and 27.2°; and no diffraction peak is other than 24.0° at an angle greater than 23.0° and less than 25.0°, wherein said angles may vary by ±0.2°, which was the titanylphthalocyanine of the present invention. The X-ray diffraction spectrum thereof is illustrated in FIG. 11.

Pigment Dispersion Preparation Example 3

The following materials were dispersed in a glass pot having a diameter of 9 cm together with PSZ balls having a diameter of 2 mm with a marketed disperser at 100 rpm for 5 hrs to prepare a pigment dispersion 3.

| | |
|---|---|
| Titanylphthalocyanine prepared as above | 3 |
| Tetrahydrofuran | 92 |
| Ion-exchanged water | 5 |

When the thus prepared titanylphthalocyanine powder was subjected to the X-ray diffraction analysis under the same conditions as above, titanylphthalocyanine powder had an X-ray diffraction spectrum, wherein main diffraction peaks are observed at a Bragg (2θ) angle of 7.3°, 9.4°, 9.6°, 24.0° and 27.2°; and diffraction peaks are observed at 23.5° and 24.5° other than 24.0° at an angle greater than 23.0° and less than 25.0°, wherein said angles may vary by ±0.2°, which was different from the titanylphthalocyanine of the present invention.

Pigment Dispersion Preparation Example 4

The procedure for preparation of the pigment dispersion 3 was repeated except for changing the dispersion time to 30 hrs prepare a pigment dispersion 4.

When the thus prepared titanylphthalocyanine powder was subjected to the X-ray diffraction analysis under the same conditions as above, titanylphthalocyanine powder had an X-ray diffraction spectrum, wherein main diffraction peaks are observed at a Bragg (2θ) angle of 7.3°, 9.6°, 24.0° and 27.2°; and no diffraction peak is other than 24.0° at an angle greater than 23.0° and less than 25.0°, wherein said angles may vary by ±0.2°, which was the titanylphthalocyanine of the present invention.

Comparative Example 1

A photosensitive layer coating liquid was prepared using the following materials.

| | |
|---|---|
| Pigment Dispersion 1 | 40 |
| Electron transport material 1-1 | 20 |
| Positive-hole transport material having the following formula (HTM1) | 30 |

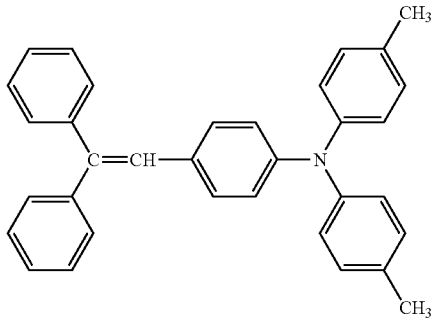

(HTM1)

| | |
|---|---|
| Z-type polycarbonate resin (Panlite TS-2050 from Teijin Chemicals Ltd.) | 50 |
| Silicone oil (KF50 from Shin-Etsu Chemical Co., Ltd.) | 0.01 |
| Tetrahydrofuran | 350 |

The thus prepared photosensitive layer coating liquid was coated on an aluminum drum having a diameter of 30 mm and a length of 340 mm by a dip coating method to form a photosensitive layer 25 μm thick thereon, and the layer was dried 120° C. for 20 min to prepare a photoreceptor 1.

Example 1

The procedure for preparation of the photoreceptor 1 in Comparative Example 1 was repeated to prepare a photoreceptor 2 except for replacing the pigment dispersion 1 with the pigment dispersion 2.

Comparative Example 2

The procedure for preparation of the photoreceptor 1 in Comparative Example 1 was repeated to prepare a photoreceptor 3 except for replacing the pigment dispersion 1 with the pigment dispersion 3.

Example 2

The procedure for preparation of the photoreceptor 1 in Comparative Example 1 was repeated to prepare a photoreceptor 4 except for replacing the pigment dispersion 1 with the pigment dispersion 4.

Example 3

The procedure for preparation of the photoreceptor 2 in Example 1 was repeated to prepare a photoreceptor 5 except for replacing the electron transport material 1-1 with the electron transport material 1-2.

Example 4

The procedure for preparation of the photoreceptor 2 in Example 1 was repeated to prepare a photoreceptor 6 except for replacing the electron transport material 1-1 with the electron transport material 1-6.

Example 5

The procedure for preparation of the photoreceptor 2 in Example 1 was repeated to prepare a photoreceptor 7 except for replacing the electron transport material 1-1 with the electron transport material 1-7.

Example 6

The procedure for preparation of the photoreceptor 2 in Example 1 was repeated to prepare a photoreceptor 8 except for replacing the electron transport material 1-1 with the electron transport material 1-8.

Example 7

The procedure for preparation of the photoreceptor 2 in Example 1 was repeated to prepare a photoreceptor 9 except for replacing the electron transport material 1-1 with the electron transport material 1-9.

Example 8

The procedure for preparation of the photoreceptor 2 in Example 1 was repeated to prepare a photoreceptor 10 except for replacing the electron transport material 1-1 with the electron transport material 1-11.

Example 9

The procedure for preparation of the photoreceptor 2 in Example 1 was repeated to prepare a photoreceptor 11 except for replacing the electron transport material 1-1 with the electron transport material 1-13.

Comparative Example 3

The procedure for preparation of the photoreceptor 2 in Example 1 was repeated to prepare a photoreceptor 12 except for replacing the electron transport material 1-1 with an electron transport material having following formula (ETM1).

(ETM1)

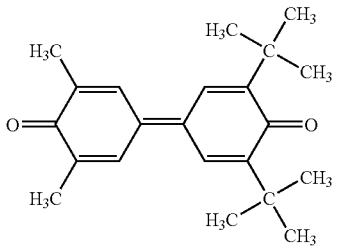

Comparative Example 4

The procedure for preparation of the photoreceptor 2 in Example 1 was repeated to prepare a photoreceptor 13 except for replacing the electron transport material 1-1 with an electron transport material having following formula (ETM2).

(ETM2)

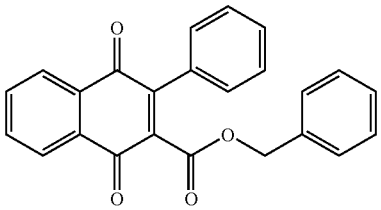

A blank image was produced to see the number and sizes of black spots on the background.

◎: Very good

○: Good

Δ: Slightly poor x: Very poor

■ Irradiated part potential (IP)

After the photoreceptor was charged to have a potential of +600V, the surface thereof was wholly irradiated and the potential thereof when transported to the developing part was measured.

The results are shown in Table 2.

TABLE 2

| | | | | Initial | | | After 50,000 | | |
|---|---|---|---|---|---|---|---|---|---|
| | Photoreceptor | TiOPc | ETM | RI | BF | IP (V) | RI | BF | IP (V) |
| Comparative Example 5 | Photoreceptor 1 | Dispersion 1 | 1-1 | ○ | ○ | 90 | Δ | Δ | 100 |
| Example 10 | Photoreceptor 2 | Dispersion 2 | 1-1 | ◎ | ◎ | 100 | ◎ | ◎ | 110 |
| Comparative Example 6 | Photoreceptor 3 | Dispersion 3 | 1-1 | ○ | ○ | 95 | Δ | Δ | 120 |
| Example 11 | Photoreceptor 4 | Dispersion 4 | 1-1 | ◎ | ◎ | 100 | ◎ | ◎ | 120 |
| Example 12 | Photoreceptor 5 | Dispersion 2 | 1-2 | ◎ | ◎ | 100 | ◎ | ◎ | 115 |
| Example 13 | Photoreceptor 6 | Dispersion 2 | 1-6 | ◎ | ◎ | 100 | ◎ | ◎ | 115 |
| Example 14 | Photoreceptor 7 | Dispersion 2 | 1-7 | ◎ | ◎ | 105 | ◎ | ◎ | 120 |
| Example 15 | Photoreceptor 8 | Dispersion 2 | 1-8 | ◎ | ◎ | 100 | ◎ | ◎ | 115 |
| Example 16 | Photoreceptor 9 | Dispersion 2 | 1-9 | ◎ | ◎ | 95 | ◎ | ◎ | 120 |
| Example 17 | Photoreceptor 10 | Dispersion 2 | 1-11 | ◎ | ◎ | 110 | ◎ | ○ | 130 |
| Example 18 | Photoreceptor 11 | Dispersion 2 | 1-13 | ◎ | ◎ | 100 | ○ | ○ | 150 |
| Comparative Example 7 | Photoreceptor 12 | Dispersion 2 | ETM1 | Δ | ◎ | 190 | X | ○ | 260 |
| Comparative Example 8 | Photoreceptor 13 | Dispersion 2 | ETM2 | Δ | ◎ | 160 | X | ○ | 245 |

Examples 10 to 18 and Comparative Examples 5 to 8

Each of the photoreceptors 1 to 13 was installed in a modified image forming apparatus imagio Neo 270 from Ricoh Company, Ltd., wherein a power pack is exchanged such that the photoreceptor is positively charged. 50,000 A4 sheets of letter image having an image area of 5% are averagely written on were continuously produced thereby in an environment having a temperature of 23° C. and a humidity of 55% Rh.

A toner and a developer each having a polarity reverse to those of an exclusive toner and an exclusive developer for imagio Neo 270 were used.

A charging roller having an outer power source applies a bias to the photoreceptor so as to have a potential of +600V. The developing bias was +450V.

Before and after the 50,000 letter images were produced, the residual image, background fouling and irradiated part potential were evaluated.

■ Residual image evaluation (RI)

Figure 12:
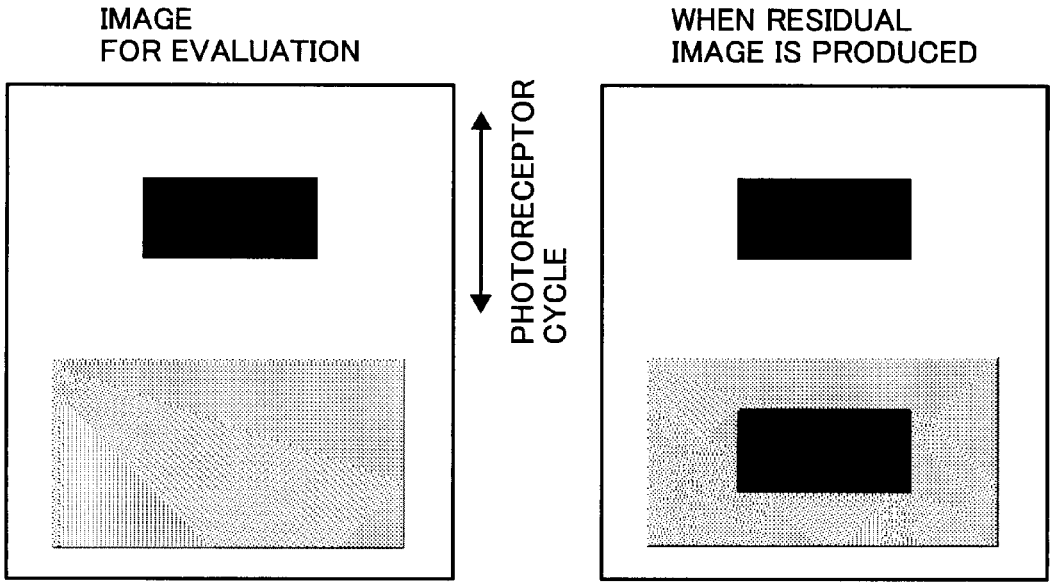
FIG. 12 is a schematic view illustrating an image for evaluation used in Examples.

An image for evaluation as shown in FIG. 12 was produced to evaluate the residual image.

◎: No residual image

○: Slightly visible

Δ: A residual image emerges x: Residual images badly emerge

■ Background fouling evaluation (BF)

Examples 19 to 27 and Comparative Examples 9 to 12

Each of the photoreceptors 1 to 13 was installed in a modified full-color tandem image forming apparatus IPSiO Color 8100 from Ricoh Company, Ltd., wherein a power pack is exchanged such that the photoreceptor is positively charged and the LD emitting writing light was changed to a LD emitting light having a wavelength of 780 nm. 50,000 A4 sheets of letter image having an image area of 5% are averagely written on were continuously produced thereby in an environment having a temperature of 23° C. and a humidity of 55% Rh.

A toner and a developer each having a polarity reverse to those of an exclusive toner and an exclusive developer for imagio Neo 270 were used.

A charging roller having an outer power source applies an AC bias having a voltage of 1.9 kV between peaks and a frequency of 1.35 kHz and a DC bias to the photoreceptor so as to have a potential of +600V. The developing bias was +450V.

Before and after the 50,000 letter images were produced, the residual image, background fouling and irradiated part potential were evaluated.

After the 50,000 letter images were produced, the background fouling and color reproducibility were evaluated.

■ Background fouling evaluation (BF)

A blank image was produced to see the number and sizes of black spots on the background.

◎: Very good

○: Good

Δ: Slightly poor x: Very poor

■ Color reproducibility

Before and after the 50,000 letter images were produced, a same color image was produced to evaluate the color reproducibility.

◎: Very good

○: Good

Δ: Slightly poor x: Very poor

The results are shown in Table 3.

TABLE 3

| | Photoreceptor | After 50,000 | |
|---|---|---|---|
| | | Background fouling | Color reproducibility |
| Comparative Example 9 | Photoreceptor 1 | Δ | Δ |
| Example 19 | Photoreceptor 2 | ◎ | ◎ |
| Comparative Example 10 | Photoreceptor 3 | Δ | Δ |
| Example 20 | Photoreceptor 4 | ◎ | ◎ |
| Example 21 | Photoreceptor 5 | ◎ | ◎ |
| Example 22 | Photoreceptor 6 | ◎ | ◎ |
| Example 23 | Photoreceptor 7 | ◎ | ◎ |
| Example 24 | Photoreceptor 8 | ◎ | ◎ |
| Example 25 | Photoreceptor 9 | ◎ | ○ |
| Example 26 | Photoreceptor 10 | ○ | ○ |
| Example 27 | Photoreceptor 11 | ○ | ○ |
| Comparative Example 11 | Photoreceptor 12 | ○ | X |
| Comparative Example 12 | Photoreceptor 13 | ○ | X |

The absorbances of the photosensitive layers of the photoreceptors 1 and 2 were measured.

Figure 13:
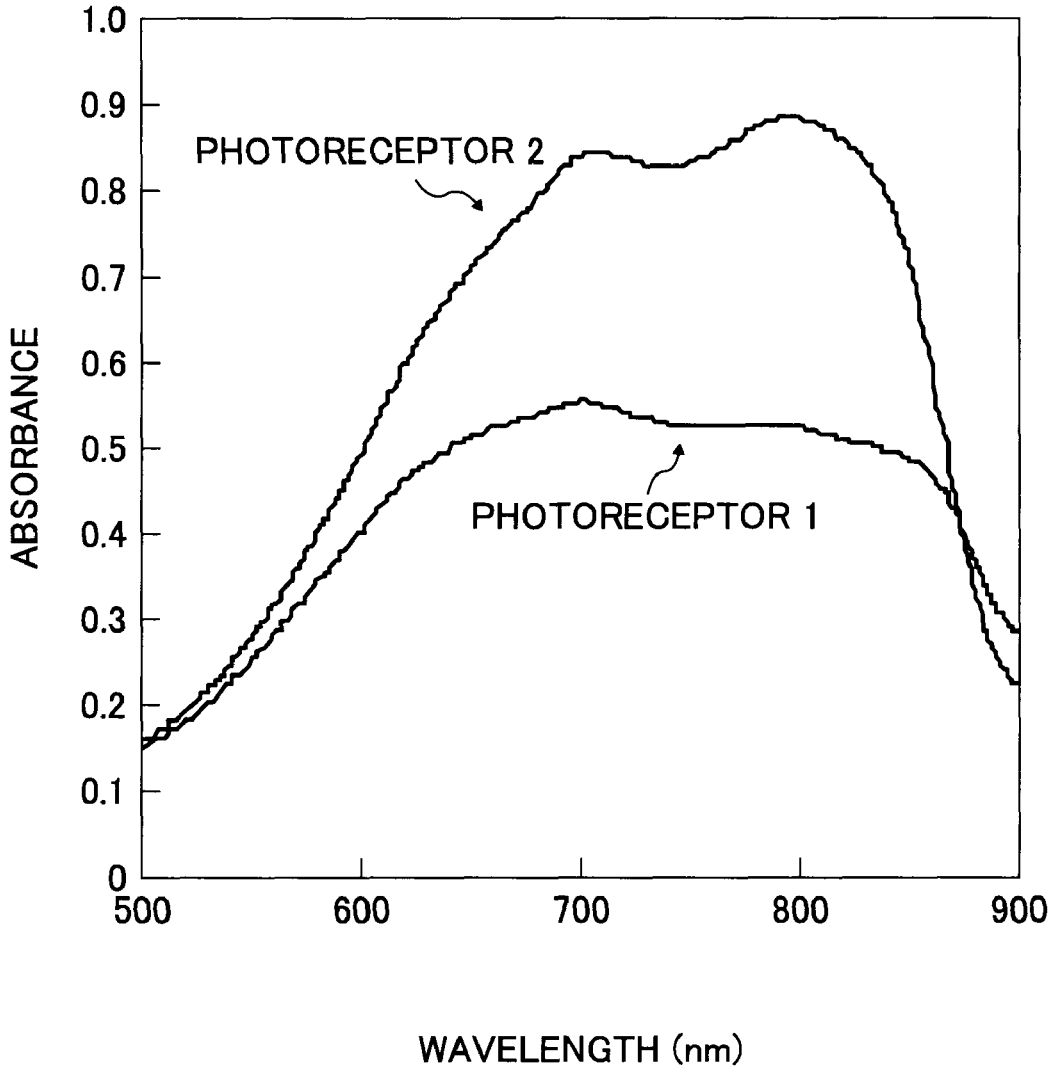
FIG. 13 is a diagram showing absorbances of photoreceptors 1 and 2.

The results are shown in FIG. 13.

The absorbances of the photosensitive layers peeled off from the aluminum substrates of the photoreceptors were measured with UV3100 from Shimadzu Corp.

As shown in FIG. 13, the absorbances are largely different from each other depending on their crystal forms. The photoreceptor 2 satisfying the requirements of the present invention has a large absorbance.

The photoreceptor satisfying the requirements of the present invention does not produce images having residual images or background fouling even after repeatedly uses, and has less variation of the irradiated part. Therefore, the image forming apparatus of the present invention produces high-quality images without abnormal images such as residual images for long periods. In addition, a full-color image forming apparatus using the photoreceptor of the present invention has good color reproducibility even after repeatedly used and produces high-quality full-color images for long periods.

Further, the photoreceptor using the titanylphthalocyanine of the present invention in its photosensitive layer has a large absorbance (small transmission), and a charge generation area is limited close to the surface of the photosensitive layer and an excessive charge is not generated therein. Therefore, a carrier smoothly transports therein and the stagnation thereof causing residual images is thought to hardly occur.

This application claims priority and contains subject matter related to Japanese Patent Application No. 2006-307475 filed on Nov. 14, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising:

an electroconductive substrate; and a photosensitive layer overlying the electroconductive substrate, wherein the photosensitive layer is a single-layered layer comprising a charge generation material and an electron transport material, wherein the charge generation material is a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.6° and 24.0°; and a minimum diffraction peak is observed at 7.3°; no diffraction peak is observed at an angle greater than 7.3° and less than 9.4°; and no diffraction peak other than 24.0° is observed at an angle greater than 23.0° and less than 25.0°, wherein said angles may vary by ±0.2°, and wherein the electron transport material is:

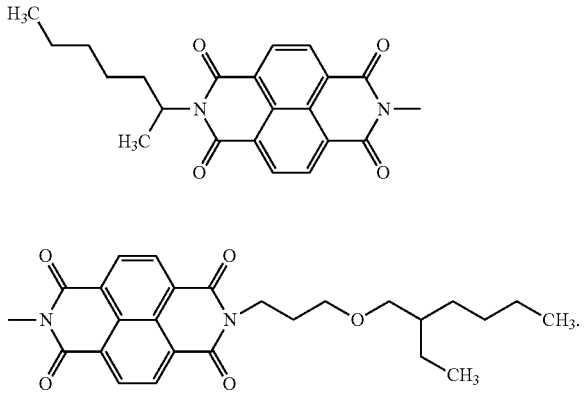

2. The electrophotographic photoreceptor of claim 1, wherein the titanylphthalocyanine is converted from a titanylphthalocyanine having a CuKα 1.542 Å X-ray diffraction spectrum comprising plural diffraction peaks, wherein a maximum diffraction peak is observed at a Bragg (2θ) angle of 27.2°; main peaks are observed at 9.4°, 9.6° and 24.0°; and a minimum diffraction peak is observed at 7.3°; and no diffraction peak is observed at an angle greater than 7.3° and less than 9.4°, wherein said angles may vary by ±0.2°.

3. The electrophotographic photoreceptor of claim 1, wherein the photosensitive layer further comprises a positive-hole transport material represented by the following structural formula:

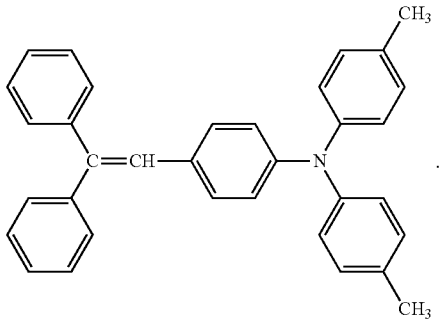

4. An image forming apparatus, comprising a unit of:

the electrophotographic photoreceptor according to claim 1, a charger configured to charge the electrophotographic photoreceptor;

an irradiator configured to form an electrostatic latent image thereon;

an image developer configured to develop the electrostatic latent image with a developer comprising a toner to form a toner image on the electrophotographic photoreceptor;

a transferer configured to transfer the toner image onto a transfer medium; and a fixer configured to fix the toner image on the transfer medium.

5. The image forming apparatus of claim 4, further comprising a plurality of the units, wherein one-colored color toner images formed by each thereof are overlapped to form a full-color image.

6. A process cartridge detachable from an image forming apparatus, comprising the electrophotographic photoreceptor according to claim 1 and at least one of a charger an irradiator, an image developer, a transferer, a cleaner and a discharger.

7. An image forming apparatus, comprising the process cartridge according to claim 6.

8. An image forming apparatus, comprising a plurality of the process cartridge according to claim 6.

* * * * *